US010240758B2

(12) United States Patent
Maglica

(10) Patent No.: US 10,240,758 B2
(45) Date of Patent: Mar. 26, 2019

(54) APPARATUS FOR CREATING A STORAGE COMPARTMENT IN A FLASHLIGHT AND METHOD OF ITS USE

(71) Applicant: Mag Instrument, Inc., Ontario, CA (US)

(72) Inventor: Anthony Maglica, Ontario, CA (US)

(73) Assignee: MAG INSTRUMENT, INC., Ontario, CA (US)

( * ) Notice: Subject to any disclaimer, the term of this patent is extended or adjusted under 35 U.S.C. 154(b) by 0 days.

(21) Appl. No.: 15/452,088

(22) Filed: Mar. 7, 2017

(65) Prior Publication Data

US 2018/0259168 A1 Sep. 13, 2018

(51) Int. Cl.
*F21L 4/00* (2006.01)
*F21V 19/04* (2006.01)

(52) U.S. Cl.
CPC ..... *F21V 19/047* (2013.01); *F21L 4/00* (2013.01); *F21L 4/005* (2013.01)

(58) Field of Classification Search
CPC ..... F21V 31/005; F21V 19/047; F21L 4/00
See application file for complete search history.

(56) References Cited

U.S. PATENT DOCUMENTS 2,530,913 A * 11/1950 Shackel ..... F21L 4/00 362/205
4,250,446 A * 2/1981 Ponte ..... F21V 19/047 324/506
4,530,039 A * 7/1985 Shin-Shi ..... F21L 15/04 362/158
4,577,263 A 3/1986 Maglica
5,197,796 A * 3/1993 Moore ..... F21L 4/005 362/157
5,260,858 A 11/1993 Maglica
5,309,337 A * 5/1994 Groben ..... F21L 15/02 362/188
5,483,429 A 1/1996 Chu
5,573,109 A 11/1996 Issacson
5,826,971 A * 10/1998 Kibler ..... F21L 15/02 362/187
5,909,952 A * 6/1999 Guthrie ..... F21L 2/00 362/184
5,941,629 A * 8/1999 Tuscher ..... F41H 9/10 222/113
6,286,973 B1 * 9/2001 Thrower ..... F21V 33/0052 340/438
6,361,183 B1 3/2002 Maglica
6,663,257 B2 12/2003 Galli
7,070,297 B1 7/2006 Muhlnickel, Jr.
(Continued)

OTHER PUBLICATIONS

Website, VSSL, Outdoor Utility Tools, http://www.vsslgear.com; attached (2 pages).

*Primary Examiner* — Anh T Mai
*Assistant Examiner* — Arman B Fallahkhair
(74) *Attorney, Agent, or Firm* — Roy L Anderson

(57) ABSTRACT

A storage compartment for a flashlight with a cylindrical barrel, a tail cap and a conductive spring fitted to the tail cap. The conductive spring is removed from the tail cap and fitted to the barrel end of a cylindrical compartment which has an outer diameter substantially the same as that of the barrel and then the tail cap is threaded into a tail cap end of the cylindrical compartment, thus sealing off an inner compartment.

12 Claims, 5 Drawing Sheets

(56) References Cited

U.S. PATENT DOCUMENTS

| | | | | |
|---|---|---|---|---|
| 7,083,298 | B2 * | 8/2006 | Pritchard | B62J 6/02 362/184 |
| 8,360,596 | B2 * | 1/2013 | Bertken | F21L 4/022 362/120 |
| 8,366,290 | B2 | 2/2013 | Maglica | |
| 9,508,391 | B2 | 11/2016 | Bushee | |
| 2003/0002274 | A1 * | 1/2003 | Thrower | F21V 33/0052 362/86 |
| 2008/0025018 | A1 | 1/2008 | Sandy | |

* cited by examiner

APPARATUS FOR CREATING A STORAGE COMPARTMENT IN A FLASHLIGHT AND METHOD OF ITS USE

FIELD OF THE INVENTION

The present invention is in the field of flashlights and, more particularly, for a storage compartment for use in a flashlight.

BACKGROUND OF THE INVENTION

Flashlights are now ubiquitous for a wide variety of uses, and over one hundred million machined aluminum flashlights have been sold by Mag Instrument alone under the registered trademarks MagLite® and Mini Maglite®. The construction of such flashlights is well known and illustrated in U.S. Pat. Nos. 4,577,263 and 5,260,858, the disclosures of which are specifically incorporated herein by reference.

Machined aluminum flashlights typically have an aluminum barrel, as is the case with the MagLite® and Mini Maglite® flashlights, a tail cap at a rear end of the barrel, which can be removed to replace one or more batteries held in a series configuration within the barrel, and a head at the opposite end of the barrel containing a lighting assembly for emitting light. It is well known that the tail cap can contain a lip seal and threads so that it can be removably threaded into the flashlight barrel and also be configured to receive the conductive spring so that the conductive spring will complete an electrical circuit to produce light when the flashlight is switched on.

SUMMARY OF THE INVENTION

The present invention is generally directed to an apparatus and method for creating a storage compartment in a flashlight with a cylindrical barrel, a tail cap and a conductive spring fitted to the tail cap such as existing machined aluminum flashlights already in use.

In accordance with the present invention, the conductive spring is removed from the tail cap and fitted to a barrel end of a cylindrical compartment which has an outer diameter substantially the same as that of the barrel and then the tail cap is threaded into a tail cap end of the cylindrical compartment, thus sealing off an inner compartment (which can be waterproof with only a single opening which is sealed by the tail cap). The cylindrical compartment can have a forward open area, which is proximate the barrel, configured to receive a spare bulb for the flashlight. The cylindrical compartment can be sold as an aftermarket product for use with existing flashlights or be included in the design of new flashlights.

Accordingly, it is a primary object of the present invention to provide a storage compartment for flashlights.

This and further objects and advantages will be apparent to those skilled in the art in connection with the drawings and the detailed description of the invention set forth below.

BRIEF DESCRIPTION OF THE DRAWINGS

FIG. 1 is an exploded view of a prior art flashlight while

DETAILED DESCRIPTION OF THE INVENTION

The present invention is generally applicable to flashlights having a cylindrical barrel and, more particularly, a machined aluminum barrel, examples of which are described in U.S. Pat. Nos. 6,361,183 and 8,366,290, the disclosures of which are specifically incorporated by reference herein. Hereinafter, the invention will be illustrated by use of a machined aluminum flashlight without limiting the invention solely to such an embodiment.

Figure 1:
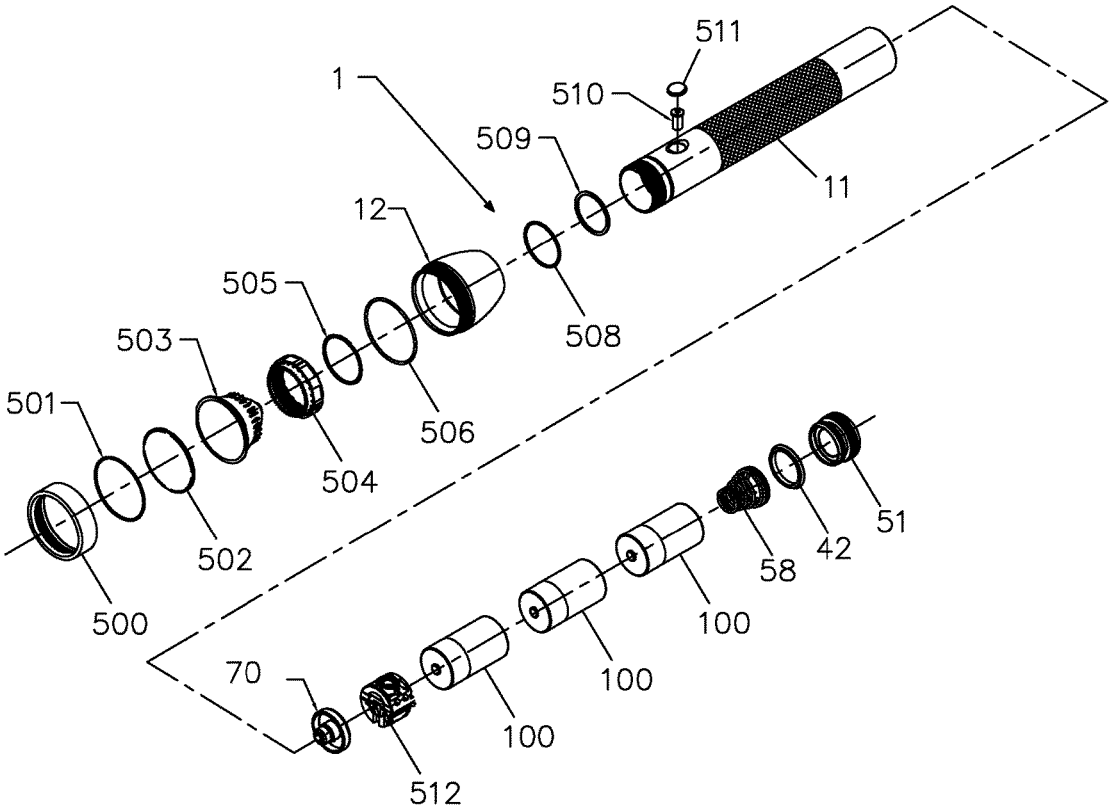
FIG. 1 (PRIOR ART)
Figure 1A:
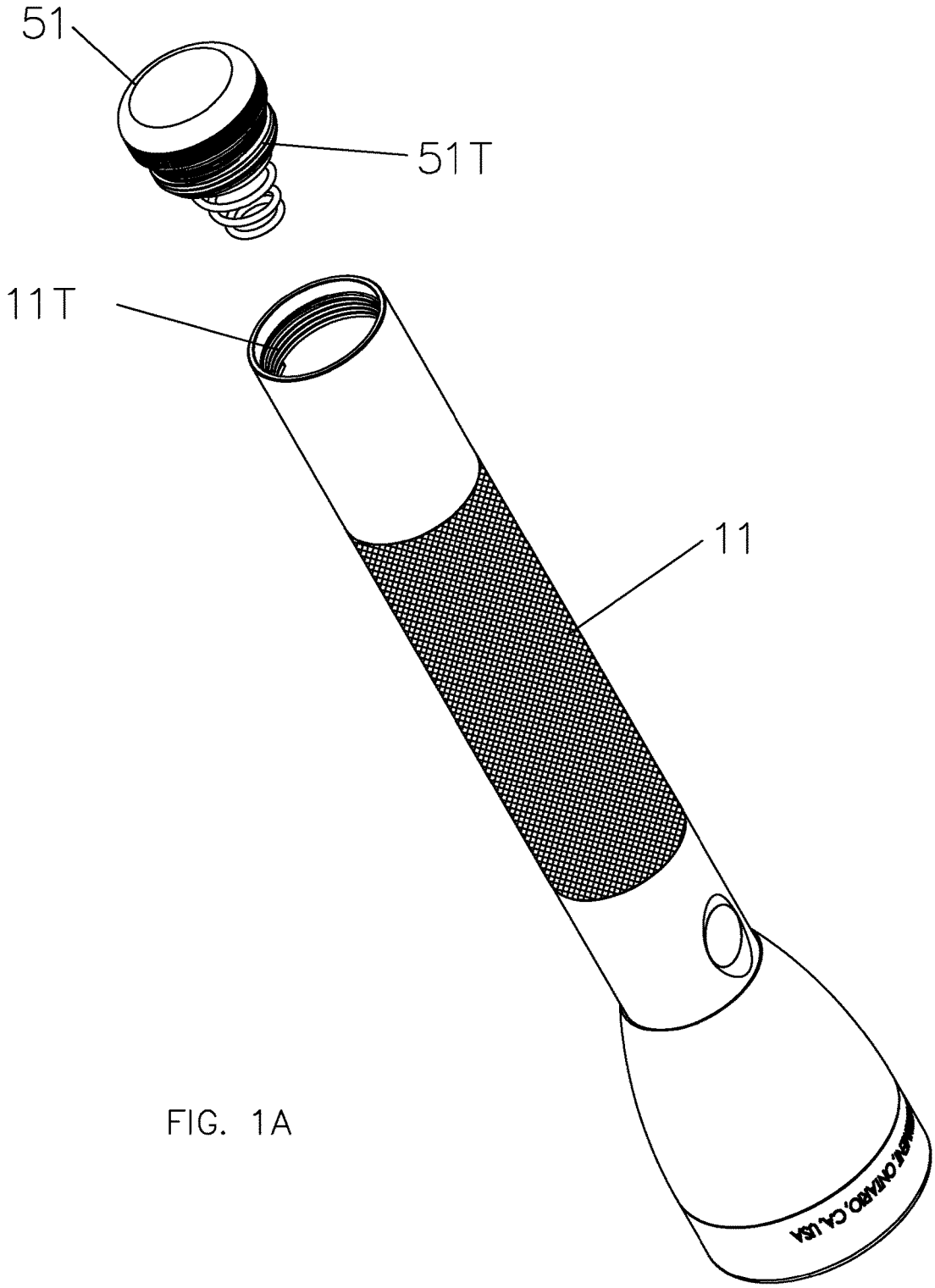
FIG. 1A is the flashlight of FIG. 1 assembled except that the tail cap assembly has been removed from the flashlight barrel.
Figure 2:
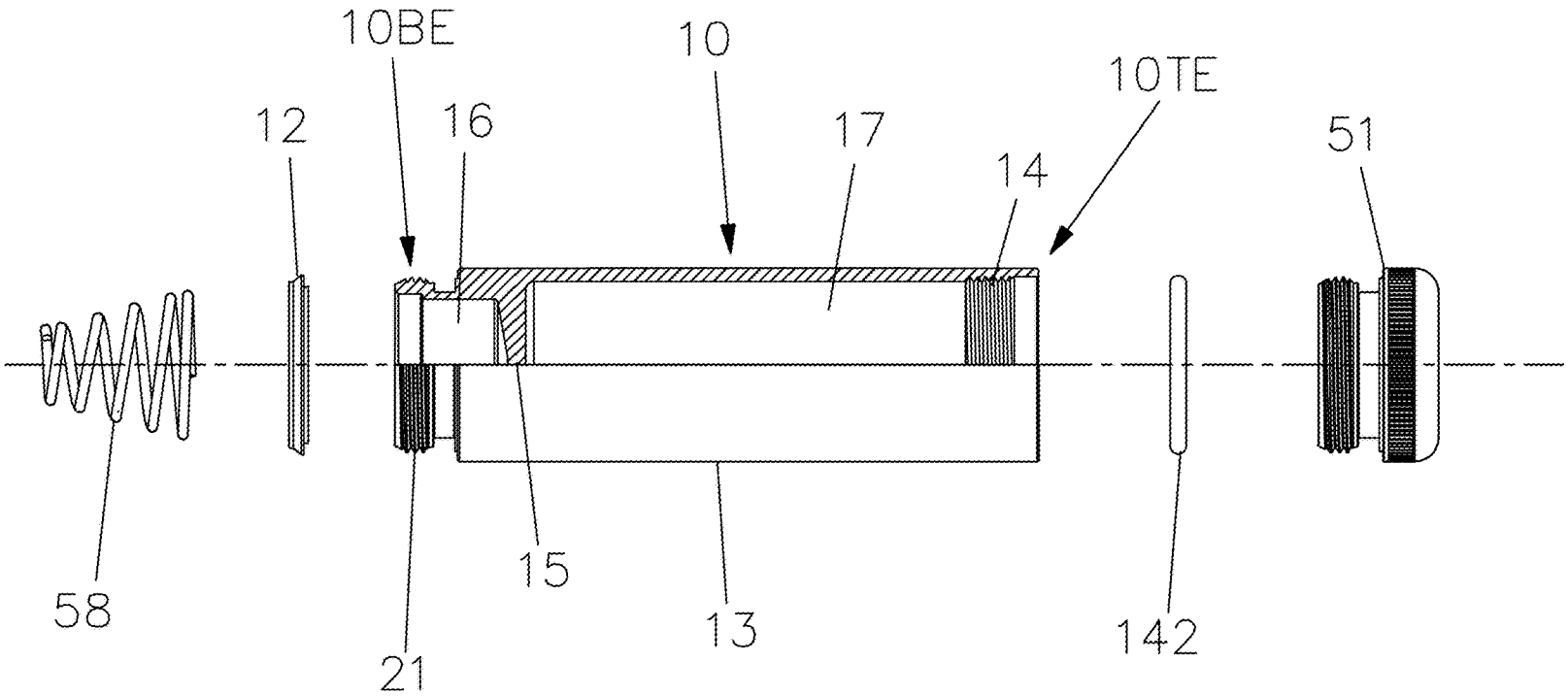
FIG. 2 is an exploded view of a storage compartment according to the present invention with a partial cutaway view along a midline.

FIG. 1 illustrates a prior art machined aluminum flashlight 1 having the following parts:

500 face cap
501 O-ring
502 lens
503 reflector
504 threaded nut
505 retaining ring
506 O-ring
12 head of flashlight
508 O-ring
509 internal snap ring
510 actuator
511 switch port seal
11 flashlight barrel
70 lighting assembly
512 switch
100 battery
58 conductive spring
42 lip seal
51 tail cap As can be seen from FIG. 1A, threads 51T of tail cap 51 are removably threaded into threads 11T of barrel 11 and conductive spring 58 is retained by tail cap 51 when tail cap 51 is removed from barrel 11.

In accordance with the present invention, a storage compartment, generally designated 10, has threads 21 at its barrel end 106E for threading into barrel 11 of flashlight 1 in the same manner as tail cap 51 is threaded into barrel 11. Storage compartment 10 has an inner wall 15 which seals off compartment 17 from anything within barrel 11. In an especially preferred embodiment, inner wall 15 is recessed from the end of compartment 10 that is threaded into barrel 11 so that there is an open area 16 between spring 58 and inner wall 15 for accommodating an extra bulb in the same fashion as was common for prior art flashlights which used bulbs, rather than LEDs, in their lighting assembly 70. Storage compartment 10 also has inner threads 14 at its tail cap end 10TE for threadably receiving threads 51T of tail cap 51 at its end opposite inner wall 15 and inner compartment 17 is only sealed off when tail cap 51 is threaded into inner threads 14. It is especially preferred, but not always required, that an O-ring 142 be used with tail cap 51 to create a watertight seal for inner compartment 17 when tail cap 51 is fully threaded into inner threads 14; alternatively, but less preferred, lip seal 42 can be left on tail cap 51, if a second lip seal 12 is either provided with storage compartment 10 or pre-assembled to compartment 10 by placing it over threads 21.

Figure 4:
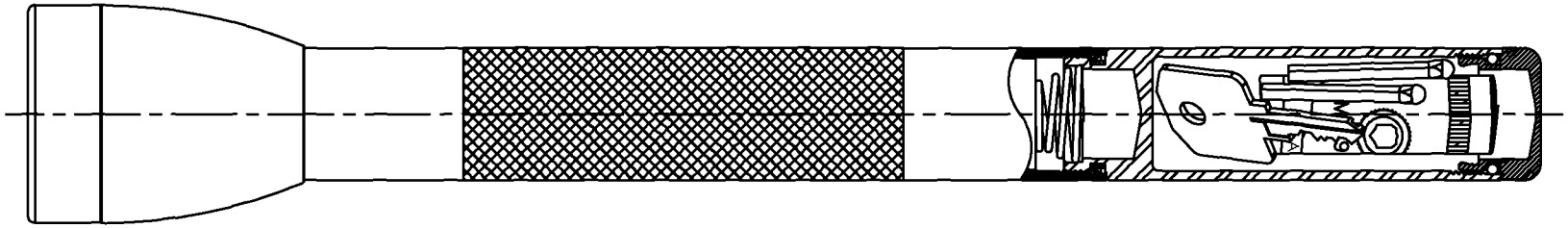
FIG. 4 illustrates use of a storage compartment, as illustrated in FIG. 2, with a prior art flashlight, such as is illustrated in FIG. 1, in partial cutaway, also illustrating storage of exemplary items within the storage compartment.

It is especially preferred that the outer diameter 13 of storage compartment 10 be substantially the same as that of barrel 11 (as shown in FIG. 4); in the context of the present invention, substantially the same means that the two outer diameters are close enough in terms of machining tolerances so that they are essentially visually indistinguishable from a distance, thus creating the visual impression that storage compartment 10 is part of barrel 11. Having substantially the same outer diameter allows storage 12 to create the appearance of being part of barrel 11 (if this is desired, and barrel 11 and storage compartment 13 have the same appearance such as, e.g., anodized black) so that storage compartment 12 is not visually apparent, but simply looks like it is part of barrel 11. This configuration provides a type of "stealth" storage compartment which some users may find useful for security and tactical purposes (for example, if the storage compartment is to be used for storing a key, fob, memory stick, cache of money, important paper(s) or the like). In addition, when storage compartment 10 functions simply as an extension of barrel 11, a flashlight fitted with such a storage compartment can easily be fitted into belt holders and other devices for holding or carrying such a flashlight, which is desirable for military, law enforcement, professional and other applications. If a "stealth" configuration is not desired, it may be desired that the outer appearance of storage compartment 12 be such that it is easily and readily recognizable—e.g., if storage compartment 12 is being used to hold medical supplies, it might be desirable for it to be colored bright red or have a bright red cross, or some other readily recognizable symbol, affixed to it, or even for it to have a window into inner compartment 17 so its contents are readily visible.

A storage compartment according to the present invention can be sold with a new flashlight or sold as an aftermarket kit for adding on to existing flashlights. Because the storage compartment must be capable of threading into a flashlight barrel in the same manner and to perform the same functions as a tail cap (with a conductive spring) for a given flashlight, and also be capable of accepting the tail cap from the same said flashlight, a storage compartment will be designed for use with a given flashlight, or series of flashlights (e.g., MAGLITE® flashlights which accept different numbers of batteries) due to the necessity of matched threading.

Storage compartments according to the present invention can have different lengths, which may be suitable for different uses, and multiple length compartments can be packaged in a single kit; similarly, "stealth" and not "stealthy" storage compartments might be sold in a single kit. Any given number of items, or types of items, can be stored in such storage compartments, with the potential end uses only being limited by user choice and imagination, as well as size of the storage compartment. Indeed, liquids can be carried inside such storage compartments, especially if the liquids are themselves stored in a separate container which is then itself stored within a storage container.

Figure 3A:
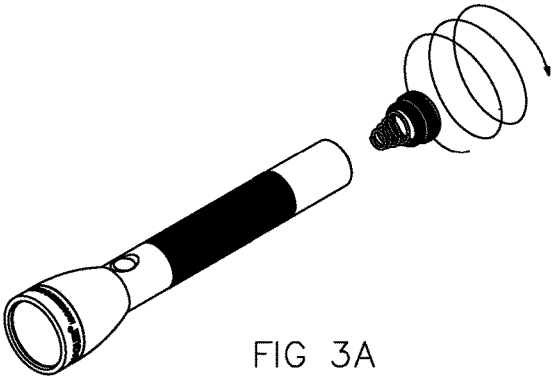
FIGS. 3A-3F illustrate an assembly process for using the storage compartment of FIG. 2 with a prior art flashlight such as is illustrated in FIG. 1.
Figure 3B:
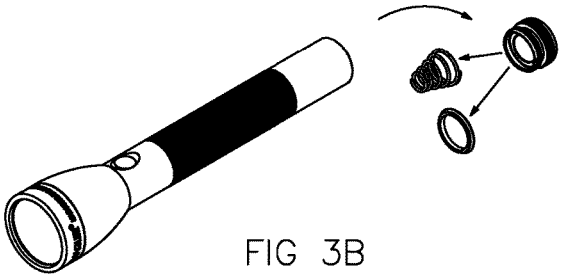
Figure 3C:
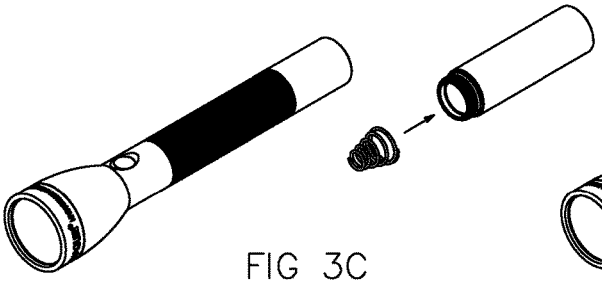
Figure 3D:
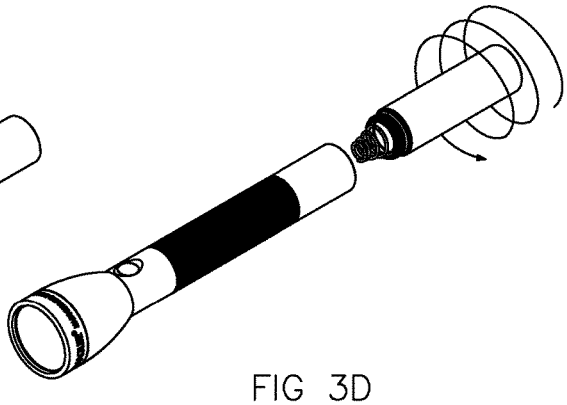
Figure 3E:
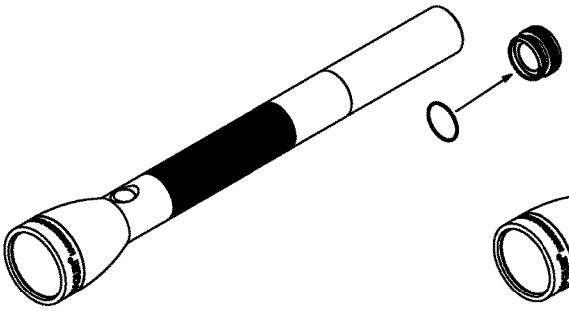
Figure 3F:
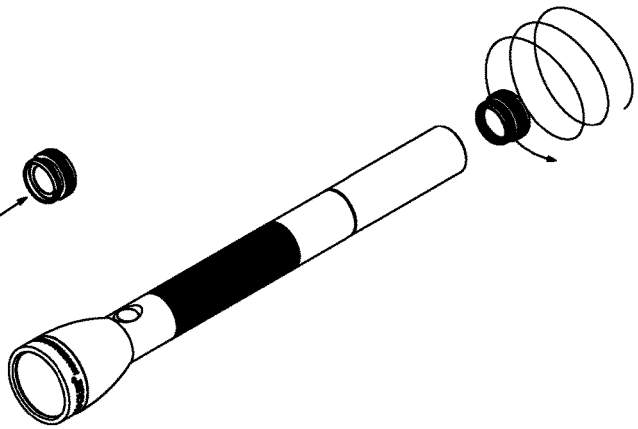

FIGS. 3A-3F illustrate how a storage compartment according to the present invention is fitted to a flashlight for which it is designed. Assuming that the storage compartment is to be added to a flashlight, the tail cap is removed from the flashlight (FIG. 3A); the conductive spring is removed from the tail cap (and, if desired, the lip seal may also be removed from the tail cap); the conductive spring is fitted to the storage compartment (FIG. 3C) (this assumes that the storage compartment comes with its own lip seal—if it does not, then the lip seal from the tail cap should also be fitted to the storage compartment); the storage compartment is threaded into the barrel of the flashlight (FIG. 3D); an O-ring is added to the tail cap (FIG. 3E) (if a watertight compartment is not needed or desired, then this step can be skipped); and the tail cap is threaded into the watertight compartment (FIG. 3F). If the storage compartment is to be removed from the flashlight, the steps would be reversed.

Once a storage compartment according to the present invention is fitted to a flashlight, the tail cap will now function akin to a lid or top for the inner compartment whereas the whole storage compartment itself will need to be removed from the flashlight barrel to gain access inside of the barrel (such as, for example, when batteries need to be changed).

While the invention has been described herein with reference to certain preferred embodiments, those embodiments have been presented by of example only, and not to limit the scope of the invention. Additional embodiments will be obvious to those skilled in the art having the benefit of this detailed description.

Accordingly, still further changes and modifications in the actual concepts descried herein can readily be made without departing from the spirit and scope of the disclosed inventions as defined by the following claims.

What is claimed is:

1. An apparatus for creating a storage compartment in a flashlight with a cylindrical barrel for housing one or more batteries, a tail cap which is configured to be removably threadable into the cylindrical barrel, and a conductive spring removably fitted to the tail cap for biasing said one or more batteries within the cylindrical barrel and completing an electrical circuit when the flashlight is switched on, comprising a cylindrical storage compartment having a barrel end and a tail cap end, wherein the barrel end is configured to receive the conductive spring and is configured with one or more sets of barrel end threads that allow the barrel end to be removably threaded into one or more sets of barrel threads inside a first outer diameter of the cylindrical barrel so that the conductive spring will complete the electrical circuit when the flashlight is switched on when the barrel end is fitted with the conductive spring and removably threaded into the cylindrical barrel, wherein the tail cap end is configured with one or more sets of tail cap end threads that allow the tail cap to be removably threaded into the tail cap end, wherein the cylindrical storage compartment has an inner storage compartment which is accessed via the tail cap end when the tail cap is not removably threaded to the tail cap end but which is sealed off by the tail cap when the tail cap is removably threaded to the tail cap end, wherein the cylindrical storage compartment has a second outer diameter which is continuously flush with a first outer diameter of the cylindrical barrel; wherein the inner storage compartment is located between the conductive spring and the tail cap end; and wherein the inner storage compartment is configured with a barrel end wall which isolates the conductive spring from the inner storage compartment and creates a barrier that prevents water from flowing between the conductive spring and the inner storage compartment.

2. The apparatus of claim 1, wherein the inner storage compartment is watertight when the tail cap is removably threaded to the tail cap end.

3. The apparatus of claim 1, further comprising a lip seal located at the barrel end.

4. The apparatus of claim 1, wherein the cylindrical storage compartment is configured so that it creates an appearance of being an extension of the cylindrical barrel when the barrel end is removably threaded into the cylindrical barrel and the tail cap is removably threaded to the tail cap end.

5. The apparatus of claim 1 wherein the inner storage compartment does not contain any of said one or more batteries.

6. The apparatus of claim 1, wherein the electrical circuit is not powered by one or more batteries contained within the inner storage compartment.

7. A flashlight, comprising:

a cylindrical barrel for housing one or more batteries having a first outer diameter, said cylindrical barrel having a first end and a second end;

a lighting assembly located at the first end;

a conductive spring;

a cylindrical storage compartment having a barrel end, a tail cap end, a barrel end wall and an inner storage compartment, wherein the barrel end wall isolates the conductive spring from the inner storage compartment and creates a barrier that prevents water from flowing between the conductive spring and the inner storage compartment, wherein the barrel end is configured to receive the conductive spring and is configured with one or more sets of barrel end threads by which the barrel end is removably threaded into one or more sets of barrel threads inside the first outer diameter in the second end of the cylindrical barrel so that the conductive spring completes an electrical circuit when the flashlight is switched on and light is emitted from the lighting assembly; and a tail cap having a third outer diameter and one or more sets of tail cap threads which is configured to be removably threadable into one or more sets of tail cap end treads inside a second outer diameter the tail cap end of the cylindrical storage compartment;

wherein the inner storage compartment is accessed via the tail cap end when the tail cap is not removably threaded to the tail cap end but which is sealed off by the tail cap when the tail cap is removably threaded to the tail cap end;

wherein the cylindrical storage compartment has a second outer diameter which is continuously flush with the first outer diameter of the cylindrical barrel and the third outer diameter of the tail cap;

wherein the inner storage compartment is located between the conductive spring and the tail cap end; and wherein the conductive spring can be removed from the barrel end, the cylindrical storage compartment can be removed from the second end, the conductive spring can be fitted to the tail cap and the tail cap can be removably threaded to the second end so that the conductive spring completes the electrical circuit when the flashlight is switched on and light is emitted from the lighting assembly.

8. The flashlight of claim 7 wherein the inner storage compartment does not contain any of said one or more batteries.

9. The flashlight of claim 7, wherein the electrical circuit is not powered by one or more batteries contained within the inner storage compartment.

10. A flashlight, comprising:

a cylindrical barrel for housing one or more batteries, said cylindrical barrel having a first outer diameter, a first end, and a second end, said second end being configured with one or more sets of barrel threads inside the first outer diameter;

a lighting assembly located at the first end;

a conductive spring located proximate the second end;

a cylindrical storage compartment having a second outer diameter, said cylindrical storage compartment comprising a barrel end, a tail cap end, an inner storage compartment and a barrel end wall, said barrel end being configured with one or more sets of barrel end threads by which the barrel end is removably threadable into said one or more sets of barrel threads, said tail cap end being configured with one or more sets of tail cap end threads inside the second outer diameter; and a tail cap having a third outer diameter, said tail cap being configured with one or more sets of tail cap threads by which the tail cap is removably threadable into said one or more sets of tail cap end treads and said one or more sets of barrel threads;

wherein the second outer diameter is continuously flush with the first outer diameter of the cylindrical barrel and the third outer diameter of the tail cap;

wherein the barrel end is configured to receive the conductive spring so that the conductive spring completes an electrical circuit when the flashlight is switched on and light is emitted from the lighting assembly;

wherein the barrel end wall isolates the conductive spring from the inner storage compartment and creates a barrier that prevents water from flowing between the conductive spring and the inner storage compartment;

wherein the inner storage compartment is accessed via the tail cap end and is located between the conductive spring and the tail cap end; and wherein the conductive spring can be removed from the barrel end, the cylindrical storage compartment can be removed from the second end, and the conductive spring can be fitted to the tail cap.

11. The flashlight of claim 10, wherein the electrical circuit can be completed when the tail cap is not threaded into said one or more sets of tail cap end treads and the barrel end is threaded into said one or more sets of barrel threads.

12. The flashlight of claim 10, wherein the electrical circuit is not powered by one or more batteries contained within the inner storage compartment.

* * * * *